US005279085A

United States Patent [19]

DiPaolo et al.

[11] Patent Number: 5,279,085

[45] Date of Patent: Jan. 18, 1994

[54] COVERED WALKWAY SYSTEM FOR A PARKING LOT

[76] Inventors: Anthony M. DiPaolo, 12379 Oak Hollow, Creve Coeur, Mo. 63141; John T. Hood, 1504 Ave. A, Webster Groves, Mo. 63119

[21] Appl. No.: 744,706

[22] Filed: Aug. 12, 1991

[51] Int. Cl.[5] ..... E04H 3/04; E02D 27/00

[52] U.S. Cl. ..... 52/169.2; 52/33; 52/86

[58] Field of Search ..... 52/33, 234, 169.2, 79.1, 52/86

[56] References Cited

U.S. PATENT DOCUMENTS

| | | | |
|---|---|---|---|
| 1,282,583 | 10/1918 | Hunter | 52/234 |
| 1,981,417 | 11/1934 | Kreutzer | 52/86 |
| 2,988,810 | 6/1961 | Wilken | 52/222 |
| 3,561,567 | 2/1971 | Bradley . | |
| 3,562,774 | 2/1971 | Stone, Jr. | 52/174 |
| 3,842,553 | 10/1974 | Billgren et al. | 52/175 |
| 4,091,584 | 5/1978 | Brown | 52/86 |
| 4,236,697 | 12/1980 | Savino | 256/1 |
| 4,884,662 | 12/1989 | Cho et al. . | |
| 4,901,482 | 2/1990 | Lockard et al. | 52/33 |

*Primary Examiner*—James L. Ridgill, Jr.

*Attorney, Agent, or Firm*—Senniger, Powers, Leavitt & Roedel

[57] ABSTRACT

A covered walkway system for a parking lot of a store such as a supermarket having a covered walkway across the front of the store, covered branch walkways extending out from the cross walkway into the lot, parking spaces marked off at opposite sides of the branch walkways, and covered corrals for shopping carts extending out from the sides of the branch walkways.

9 Claims, 3 Drawing Sheets

COVERED WALKWAY SYSTEM FOR A PARKING LOT

BRIEF SUMMARY OF THE INVENTION

This invention relates to a covered walkway system for a parking lot and more particularly to a covered walkway system for the parking lot of a store such as a supermarket which provides shopping carts for its customers for carrying purchases made in the store to the check-out counter and thence out to their cars parked in the lot.

Along the several objects of the invention may be noted the provision of a walkway system such as described providing shelter for a customer between the customer's car parked in the lot and the store, the provision of such a system having corrals for parking carts in the usual nested fashion with the carts under cover and with the corrals accessible from under cover of the system; and the provision of such a system providing for parking of substantial numbers of cars with relatively short distances for customers to walk from their parked cars to the shelter of the system and from the system out of its shelter to their parked cars.

In general, the invention involves a covered walkway system for the parking lot of a store such as a supermarket which provides shopping carts for its customers, the store having a front toward the lot. A cross walkway extends across the front of the store and branch walkways extend out into the lot from the cross walkway. Each branch walkway comprises an elongate walk on the lot and an elongate canopy structure for the walk providing cover for the walk for sheltering customers using the walk. The branch walkways are spaced at intervals sufficient for parking of cars therebetween with the cars at angles to the branch walkways, the lot having lines thereon at opposite sides of the branch walkways extending at angles to the branch walkways marking parking spaces for cars either headed into or backed up to the branch walkways. The canopy structure has access openings at the side thereof spaced at intervals along the length of the walkway for entry of customers from their cars into the covered walkway system for sheltered passage into the store and for sheltered passage of customers from the store through the covered walkway system with a shopping cart and exit from the system to their parked cars. Covered shopping cart corrals extend out from the sides of the branch walkways for covered parking of carts with the carts accessible from under cover on the branch walkways.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
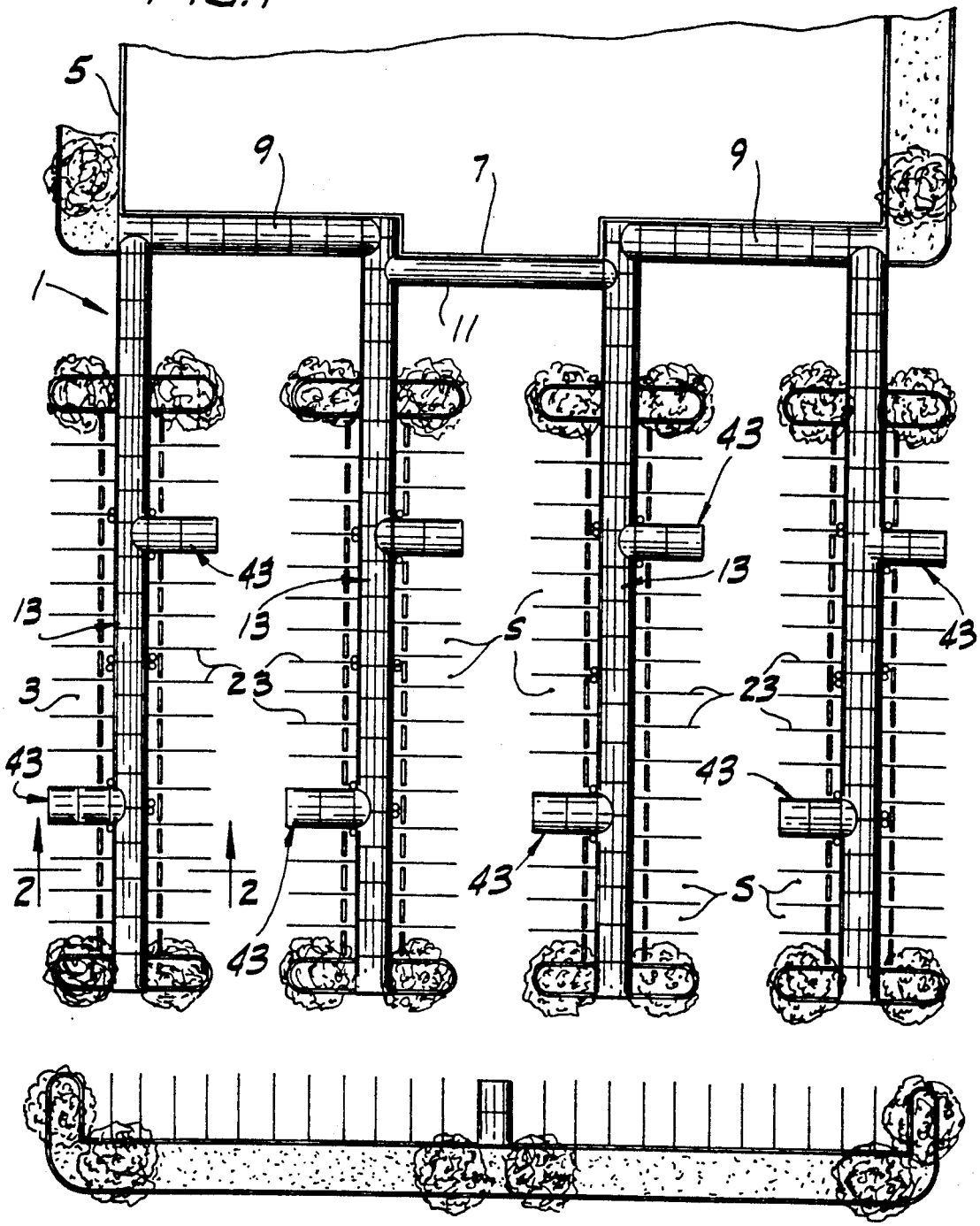
FIG. 1 is a plan of a covered walkway system of this invention for a parking lot, showing landscaping such as may be used in conjunction with the system.
Figure 2:
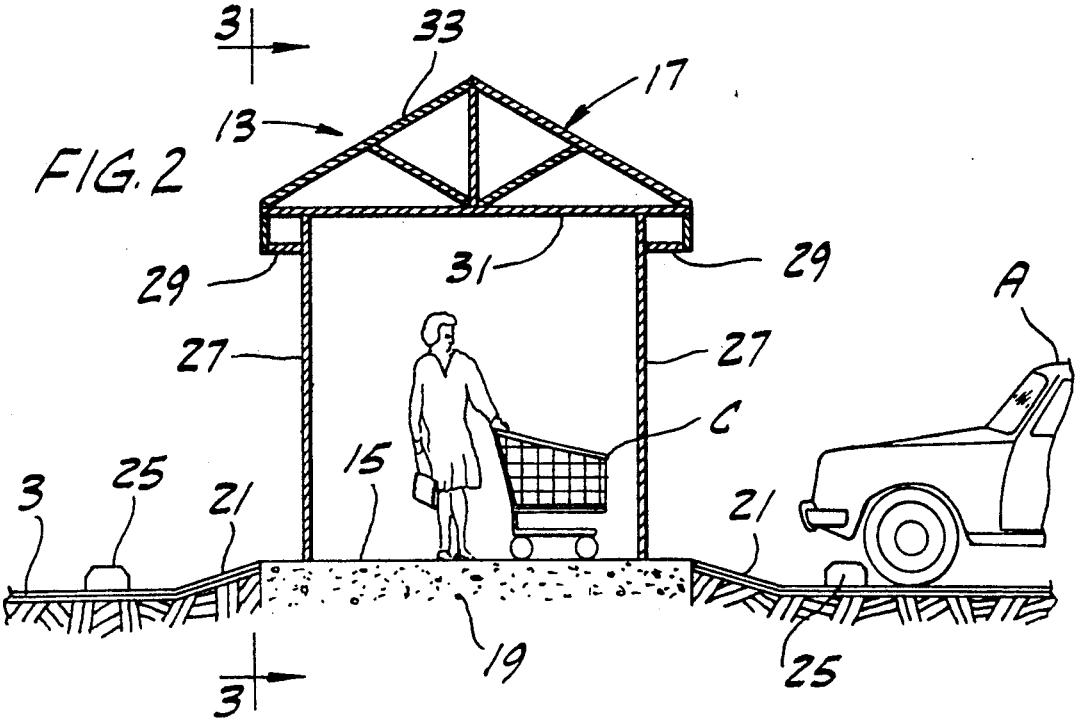
FIG. 2 is a vertical section on line 2—2 of FIG. 1.
Figure 3:
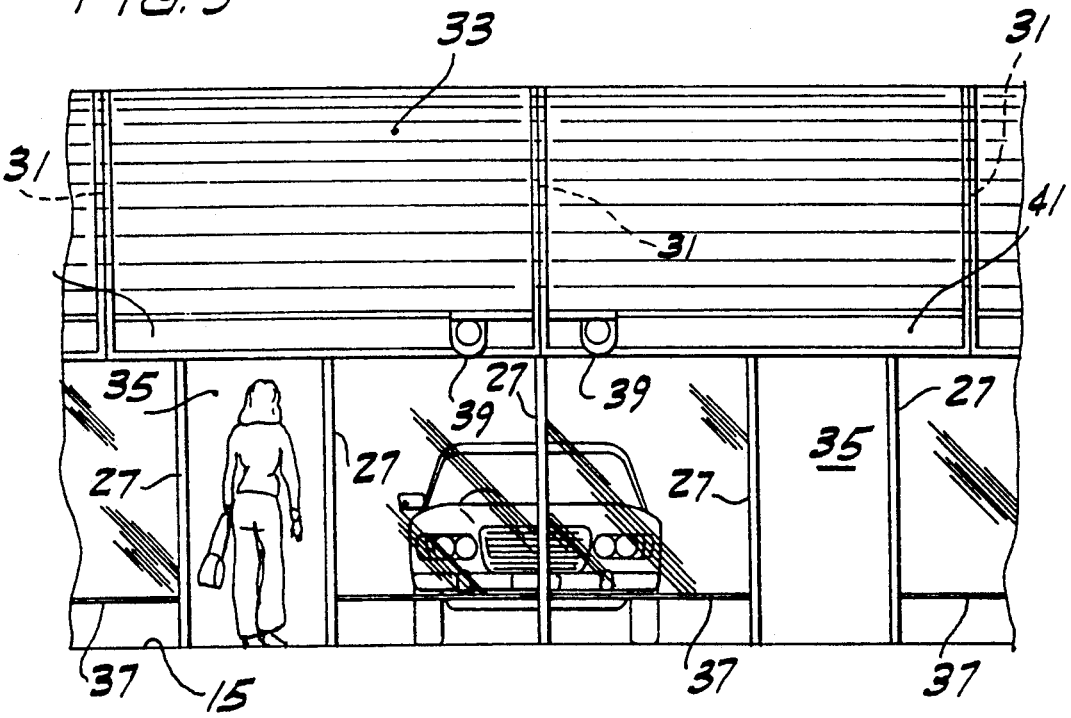
FIG. 3 is a view in side elevation on line 3—3 of FIG. 2.
Figure 4:
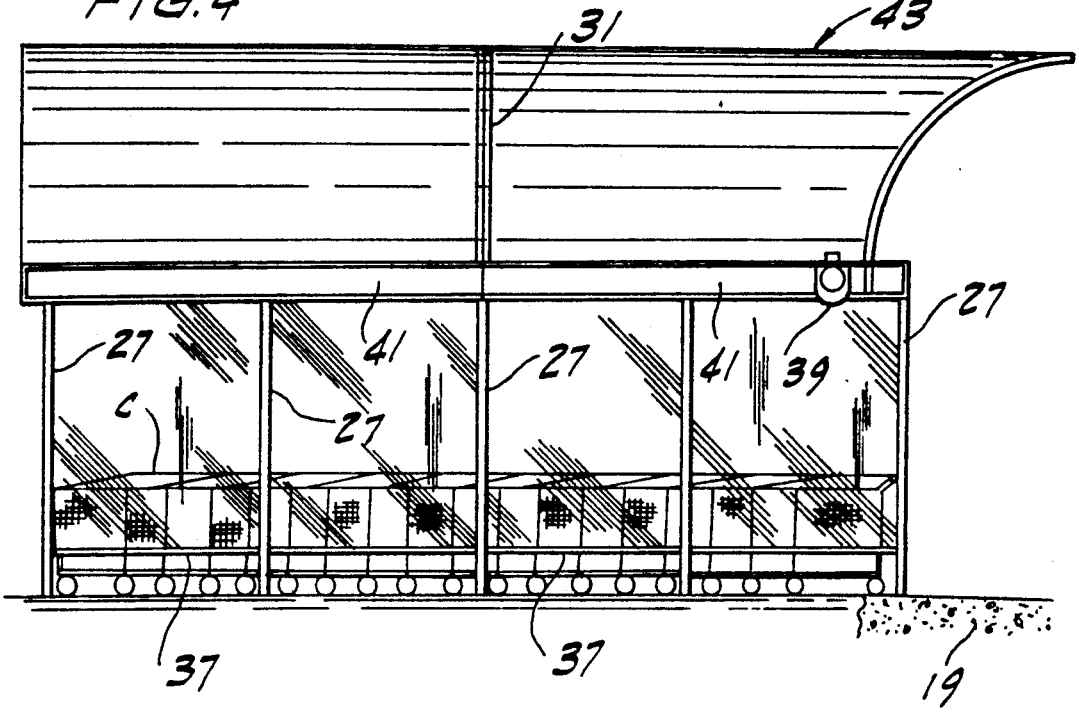
FIG. 4 is a view in side elevation of a corral of the system showing carts parked therein.

Referring to the drawings, first more particularly to FIG. 1, there is generally indicated at 1 a covered walkway system for the parking lot 3 of a store such as indicated at 5, e.g. a supermarket or other store which provides shopping carts C (see FIG. 2) for its customers. The front of the store toward the parking lot 3 is indicated at 7. Extending across the front of the store is a cross walkway 9, which may have an offset 11 in accordance with the architecture of the store front. It will be understood that there may be one or more sets of doors (not shown) for entry to the store from the cross walkway 9 and exit from the store to the cross walkway, which is of sufficient width (e.g. eight feet) for accommodating customers pushing carts exiting the store. A plurality of branch walkways each designated 13 extends out into the lot 3 from the cross walkway. Four such branch walkways are shown, each extending out into the lot from the cross walkway at right angles thereto. Each branch walkway 13 comprises an elongate walk 15 on the lot, and an elongate canopy structure 17 for the walk providing cover for the walk for sheltering customers using the walk. The latter may be a raised walk, i.e. one raised above the surface of the lot, and may be of poured concrete construction as indicated at 19 in FIG. 2. The surface of the lot is preferably sloped up at the sides of the concrete walk 15 to form sloping curbs as indicated at 21 at each side of the walk.

The walkways 13 extend parallel to each other spaced at suitable intervals, sufficient for parking of cars A therebetween with the cars generally at right angles to the walkways. The lot has lines such as indicated at 23 thereon at opposite sides of the branch walkways 13 marking parking spaces S for the cars either headed into or backed up to the branch walkways. Stops 25 are provided on the lot at the inner ends of the parking spaces outward of the curbs 21 engageable by the front wheels of a car headed into the space or the rear wheels of a car backing into a space. The parking may be at angles other than a right angle.

Each canopy structure 17 comprises posts 27 such as lengths of steel tubing set at their lower ends in the lot at opposite sides of the walkway 15, beam structures such as indicated at 29 extending along the upper ends of the posts, truss structures 31 extending transversely with respect to the walkway over the walk 15, and roofing 33 such as corrugated fiberglass roofing on the trusses. The posts are spaced so as to provide access openings or doorways 35 at suitable intervals along each side of the walkway for entry of customers from their cars into the covered walkway system for sheltered passage of customers into the store and for sheltered passage of customers from the store through the covered walkway system with a shopping cart C, and for exit from the system to their parked cars. Windscreens such as indicated at 37 may be provided at the sides between the access openings. Lighting for the walkways may be provided as indicated at 39. Graphic strips (advertising) may be applied to the inside of the beam structures at 41.

Covered corrals 43 for shopping carts C extend out from the sides of the branch walkways 13 for covered parking of the carts with the carts accessible from under cover on the branch walkway. These covered corrals may be constructed similarly to the branch walkways with a slight slope downward away from the branch walkway for expediting the parking of carts in nested fashion in the corral.

Figure 5:
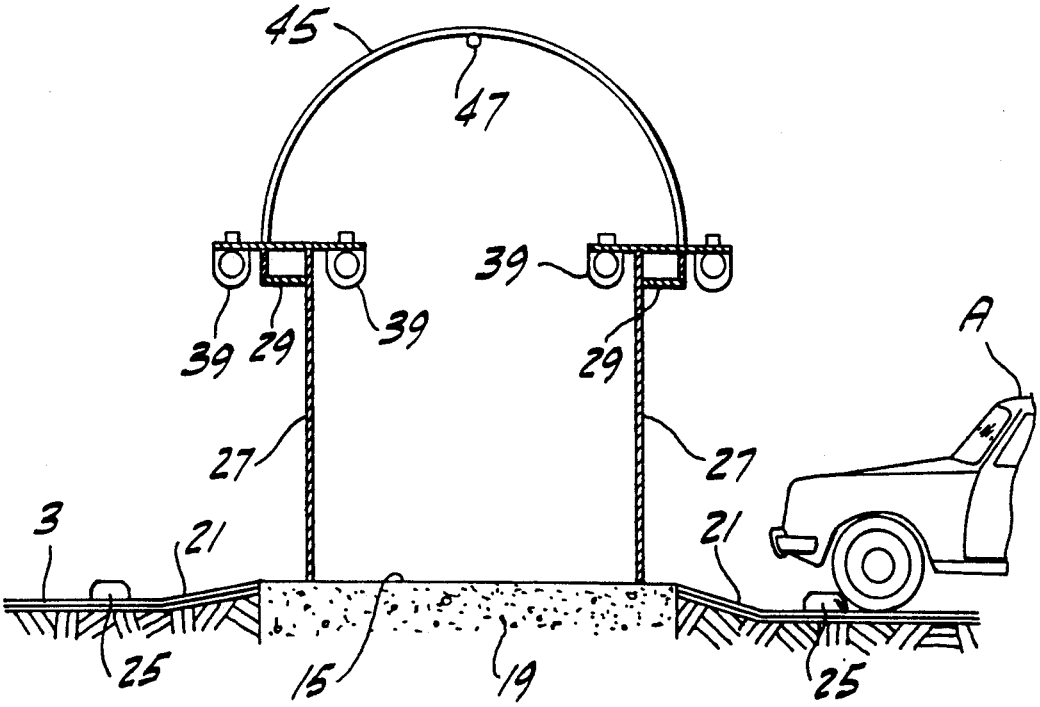
FIG. 5 is a view in section similar to FIG. 2 showing a modification.

FIG. 5 illustrates a modification wherein the top of the canopy structure comprises arch sections 45 molded in one piece of tinted high-strength acrylic plastic with an integrally molded electric conduit 47. The arch sections are supported on the beams, arching over the carts in the corral. This modification may have inside and outside lighting.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A covered walkway system for the parking lot of a store such as a supermarket which provides shopping carts for its customers, said store having a front toward the lot, a cross walkway extending across the front of the store, a plurality of branch walkways extending out into the lot from the cross walkway, each branch walkway comprising an elongate walk on the lot and an elongate canopy structure for the walk providing cover for the walk for sheltering customers using the walk, adjacent branch walkways having spaces therebetween for parking of cars with the cars at angles to the branch walkways, the lot having lines thereon at opposite sides of the branch walkways extending at angles to the branch walkways marking parking spaces for the cars either headed into or backed up to the branch walkways, the canopy structure having access openings at the side thereof spaced at intervals along the length of the walkway for entry of customers from their cars into the covered walkway system for sheltered passage into the store and for sheltered passage of customers from the store through the covered walkway system with a shopping cart and exit from the system to their parked cars, and covered shopping cart corrals extending out from the sides of the branch walkways for covered parking of carts with the carts accessible from under cover of the branch walkway.

2. A covered walkway system as set forth in claim 1 wherein each shopping cart corral comprises a canopy structure like that of the walkways.

3. A covered walkway system as set forth in claim 2 wherein each canopy structure including that of the corrals comprises a series of posts at each side, beams extending between the upper ends of the posts, and roof structure supported on the beams.

4. A covered walkway system as set forth in claim 3 wherein each corral slopes down away from the respective walkway.

5. A covered walkway system as set forth in claim 1 wherein the canopy structure comprises a series of posts at each side of the walk, beams extending between the upper ends of the posts, and roof structure supported on the beams.

6. A covered walkway system as set forth in claim 5 wherein the roof structure comprises molded plastic arch sections supported on the beams arching over the walk.

7. A covered walkway system as set forth in claim 5 having windscreens between the posts.

8. A covered walkway system as set forth in claim 5 wherein the roof structure comprises trusses spanning the beams and roofing on the trusses.

9. A covered walkway system as set forth in claim 8 wherein the roofing is corrugated fiberglass roofing.

* * * * *